US006946936B2

(12) United States Patent
Schauwecker et al.

(10) Patent No.: US 6,946,936 B2
(45) Date of Patent: Sep. 20, 2005

(54) SUPERCONDUCTING MAGNET SYSTEM WITH CONTINOUSLY OPERATING FLUX-PUMP AND ASSOCIATED METHODS FOR OPERATING THEREOF

(75) Inventors: Robert Schauwecker, Zurich (CH); Rolf Spreiter, Zurich (CH)

(73) Assignee: Bruker Biospin AG, Faellanden (CH)

( * ) Notice: Subject to any disclaimer, the term of this patent is extended or adjusted under 35 U.S.C. 154(b) by 0 days.

(21) Appl. No.: 11/008,949

(22) Filed: Dec. 13, 2004

(65) Prior Publication Data

US 2005/0127915 A1 Jun. 16, 2005

(30) Foreign Application Priority Data

Dec. 15, 2003 (DE) ..... 103 58 549

(51) Int. Cl.[7] ..... H01F 6/00
(52) U.S. Cl. ..... 335/216; 361/141
(58) Field of Search ..... 335/216, 299; 324/318–320; 361/19, 141

(56) References Cited

U.S. PATENT DOCUMENTS 3,244,943 A * 4/1966 Hildebrandt et. al. ..... 335/216
3,277,322 A 10/1966 Berlingcourt
3,568,002 A * 3/1971 Robins et al. ..... 361/141
3,848,162 A * 11/1974 Ichikawa et al. ..... 361/141
4,096,403 A * 6/1978 Rabinowitz et al. ..... 310/10
5,965,959 A * 10/1999 Gamble et al. ..... 307/125
2002/0171521 A1 * 11/2002 Ries ..... 335/216

FOREIGN PATENT DOCUMENTS

| | | |
|---|---|---|
| DE | DE 1 464 944 | 3/1969 |
| EP | EP 0 231 746 | 8/1987 |
| FR | FR 1 522 300 | 2/1967 |

OTHER PUBLICATIONS

T.P. Bernart et al., Rev. Sci. Instrum. vol. 46, No. 5, May 1975, pp. 582-585.

* cited by examiner

*Primary Examiner*—Ramon M. Barrera
(74) *Attorney, Agent, or Firm*—Paul Vincent

(57) ABSTRACT

A magnet arrangement comprising a superconducting magnet coil system (M) which has an ohmic resistance (R) of zero or more during operation, and a flux pump (P) which comprises at least one superconducting switch and at least two superconducting secondary coils (M1,M2), is characterized in that at least one superconducting current path is provided, wherein the superconducting magnet coil system (M) or parts thereof is/are connected in series with at least two secondary coils (M1, M2), and wherein at least one secondary coil (M2) can be superconductingly bridged through closing of a superconducting switch (S1), and at least two primary coils (C1, C2) are provided which can each be fed independently of each other with a current (I1, I2) and which are each inductively coupled with at least one of the secondary coils (M1, M2). The flux pump is suitable for the stabilization of the magnetic field of the magnet coil system (M) during long-term operation.

25 Claims, 3 Drawing Sheets

SUPERCONDUCTING MAGNET SYSTEM WITH CONTINOUSLY OPERATING FLUX-PUMP AND ASSOCIATED METHODS FOR OPERATING THEREOF

This application claims Paris Convention priority of DE 103 58 549.4 filed Dec. 15, 2003 the complete disclosure of which is hereby incorporated by reference.

BACKGROUND OF THE INVENTION

The invention concerns a magnet arrangement comprising a superconducting magnet coil system which has an ohmic resistance of zero or more during operation, and a flux pump which comprises at least one superconducting switch and at least two superconducting secondary coils.

A magnet arrangement of this type comprising a superconducting magnet coil system is described by T. P. Bernart et al., Rev. Sci. Instrum., Vol. 46, No. 5, May 1975, pages 582–585.

The superconducting magnet coil system comprises one or more magnet coils which are connected in series and form a closed superconducting circuit. The superconducting magnet coil system is typically disposed in a cryostat. It may have an ohmic resistance of more than zero during operation if the superconductors used are charged to a value just below the critical current or if they do not show a clear transition between the superconducting and the normal conducting states. The principle of a flux pump consists in compensating resistive losses of the magnet coil through inductive injection of energy, or in charging or discharging the coil without requiring introduction of large currents into the cryostat. The invention concerns, in particular, superconducting magnet coil systems comprising a flux pump which has at least one superconducting switch and at least two superconducting secondary coils in which a voltage may be inductively established. To be able to feed this voltage into the superconducting magnet coil system for compensating resistive losses or for charging or discharging, the secondary coils must be superconductingly connected in series with the magnet coil system as may be effected e.g. through closing of a superconducting switch.

A magnet arrangement with a flux pump which comprises at least two superconducting secondary coils, is disclosed in T. P. Bernat et. Al., Rev. Sci. Instrum., Vol. 46, No. 5, May 1975 and from L. J. M. van de Klundert et al. Al., Cryogenics, May 1981. This flux pump is based on the fact that the superconducting magnet coil system is bridged by two current paths, which each comprise one switch and one superconducting secondary coil. Current is cyclically introduced into and discharged from a primary coil whose inductive coupling is equal and opposite to the secondary coils. If the superconducting switches which are connected in series with the secondary coils, are alternately opened and closed in a same cycle, a voltage is generated across the magnet coil system which is constant throughout the entire cycle, except for voltage peaks during opening of the switches.

Flux pumps are typically used for charging and discharging superconducting magnet coil systems. The advantage compared to direct feeding of the operational current into the coils consists in that the currents for operating the flux pump are much weaker than the typical magnet currents. The current feed lines may thereby be reduced in size and the heat input into the cryostat may be decreased.

Superconducting magnets are also used for applications for which the magnet coils remain at field for years after the charging process and should have a minimum field drift. This includes, in particular, superconducting magnet coil systems for magnetic resonance methods. For such magnet systems, the use of a flux pump is not of primary interest for charging the magnet system, rather for stabilization of the magnetic field during operation. An efficient flux pump would provide various advantages in this respect. Magnets comprising partial coils of high-temperature superconductors may e.g. be constructed which do not meet the currently conventional drift specifications for magnetic resonance applications without additional measures. This would permit construction of magnets with fields which are stronger than the conventional fields today. Moreover, the use of a flux pump to stabilize the field could increase the load on the superconductors in the magnet which would permit construction of more compact and less expensive magnets.

Conventional flux pumps are not suited to be used for precise field stabilization over long time periods. Voltage peaks across the magnet coil system occur during opening of superconducting switches which cannot be tolerated for sensitive applications such as magnetic resonance methods. Moreover, at least one superconducting switch must be opened in each phase of the pump cycle to permit feeding of the voltage induced in the secondary coil into the magnet coil system. Heat is thereby generated in conventional switches which produces large losses in cooling liquid in the cryostat. The thermal stability in the cryostat is also very important for the stability of the field. For sensitive applications, such as magnetic resonance methods, the heat input into the cryostat must therefore be minimized.

It is the object of the present invention to improve a flux pump in accordance with prior art in such a manner that, in addition to charging and discharging of a superconducting magnet coil system, good long-term stabilization of the magnetic field of the magnet coil system during operation is also possible, in particular, when the magnet coil system is slightly resistive and the requirements for the field stability are very high. A particular object of the invention is to present an improved flux pump arrangement providing an operational method for applying a voltage across the magnet coil system, which is constant throughout all cycles of the flux pump.

SUMMARY OF THE INVENTION

In accordance with the invention, this object is achieved with a magnet arrangement of the above-mentioned type in that at least one superconducting current path is provided, wherein the superconducting magnet coil system or parts thereof is/are connected in series with at least two secondary coils, and wherein at least one secondary coil can be superconductingly bridged through closing a superconducting switch, and at least two primary coils are provided which can each be fed with a current independently of each other, and which are each inductively coupled with at least one of the secondary coils.

Briefly, the invention provides a superconducting current path, wherein the superconducting magnet coil system or parts thereof is/are connected in series with at least two secondary coils, and wherein at least one secondary coil can be bridged through closing a superconducting switch. In particular, the secondary coils may each be inductively coupled to one separate primary coil.

This arrangement provides an operational method for the flux pump, wherein, in a first step, a first primary coil, which is coupled to a first secondary coil, which is not superconductingly bridged, is charged until a maximum final current is obtained in the primary coil. A voltage can thereby be built up across the superconducting magnet coil system which corresponds e.g. exactly to the resistive voltage in the magnet coil system which must be compensated for. In a second step, the first primary coil must be discharged again to its initial current. During this phase, the superconducting switch is opened over a second secondary coil which has been previously superconductingly bridged via a closed switch, and the current in the primary coil which is inductively coupled to this secondary coil, is increased thereby inducing a voltage in this secondary coil. The current ramp in the second primary coil is selected such that the voltage induced in the second secondary coil compensates for the voltage induced in the first secondary coil through discharging of the first primary coil, and also for the resistive voltage across the superconducting magnet coil system. When the first primary coil has reached its initial current, the switch across the second secondary coil is closed again and the second primary coil is returned to its initial current while the switch is closed. The cycle may now start again.

The inventive arrangement is advantageous in that due to several primary coils which are provided with current independently of each other, different voltages may be induced into different secondary coils, which are added to an overall voltage by the series connection of these secondary coils. The series connection of the secondary coils with the superconducting magnet coil system permits feeding of this overall voltage into the superconducting magnet coil system. A desired voltage may be maintained across the superconducting magnet coil system through suitable method steps in each phase of the flux pump cycle due to the large flexibility of the arrangement.

It has turned out that, in the above-described operational method of the flux pump, the first secondary coil must not be superconductingly short-circuited at any time during the entire cycle. This means that, in accordance with the invention, with $n \geqq 2$ secondary coils, at the most $n-1$ secondary coils must be bridged with a switch. In the simplest case of $n=2$, only one single switch is required which must be opened only for a short time during which the current in the first primary coil is reset. This considerably reduces the heat generated by the switch heaters compared to a conventional flux pump. This embodiment of the invention is therefore particularly advantageous.

One embodiment of the inventive arrangement is also preferred, wherein a superconducting switch bridges a secondary coil together with a resistance which is connected in series with this secondary coil, wherein the resistance has a value, measured in ohms, of between 0 and the value of the inductance of this secondary coil, measured in Henrys. This arrangement is advantageous in that, during charging and discharging of a primary coil which is inductively coupled to this secondary coil, induction of currents of an uncontrolled excessive value into the secondary coil is not possible when the superconducting switch is closed.

One particularly preferred embodiment of the inventive arrangement is characterized in that a further superconducting switch is used instead of the resistance used in the above-mentioned embodiment. This embodiment provides that a superconducting switch bridges a secondary coil as well as a further superconducting switch, which is connected in series with that secondary coil (see also FIG. 3). The current in the secondary coil can thereby be precisely controlled through suitable charging and discharging of the associated primary coil and through opening and closing of the further switch. This prevents, in particular, current from flowing via the first switch at a certain point of the pump cycle before opening of the first switch. This prevents voltage pulses across the superconducting magnet coil system which is essential, in particular, in sensitive applications such as nuclear magnetic resonance methods. Moreover, no heat is generated in the first switch through dissipation of current, which further reduces cooling liquid loss. This arrangement permits an operational method for the flux pump which guarantees undisturbed continuous pump efficiency with a minimum of heat input into the cryostat.

In two further advantageous embodiments of the inventive arrangement, secondary coils are inductively coupled with exactly one primary coil or secondary coils are inductively decoupled. This improves control of the voltages induced in the secondary coils during charging or discharging of the primary coils and facilitates the methods for operating the flux pump.

Embodiments of the inventive arrangement are particularly advantageous, with which primary or secondary coils are largely inductively decoupled from the superconducting magnet coil system or substantially produce no field in the working volume of the superconducting magnet coil system, thereby preventing disturbances of the magnetic field in the working volume during operation of the flux pump.

A further advantageous embodiment of the inventive arrangement is characterized in that at least one primary coil is superconducting. A current which flows in a superconducting primary coil generates no heat in contrast to normally conducting primary coils. If the primary coils are located in the cryostat, the cooling agent losses can thereby be reduced.

Cooling agent loss can be further reduced when at least part of the feed lines to the coils in the cryostat or to the switches are also superconducting.

In another embodiment, at least one of the superconducting switches can be actuated by a heater whose feed lines are at least partially superconducting.

One advantageous embodiment of the inventive arrangement is characterized in that at least a section of the superconducting magnet coil system is bridged by a superconductor or by a resistance. This arrangement may be used to dampen the effects of small voltage fluctuations, i.e. during opening of switches of the flux pump, on the overall field of the superconducting magnet system. To render this dampening effective, the resistance (in ohms) must not exceed the magnitude of the inductance (in Henry) of the bridged section.

The inventive arrangement is particularly advantageous when used in an apparatus for nuclear magnetic resonance. A device for active field stabilization of such magnet arrangements preferably uses the inventive flux pump and must meet particularly high requirements concerning the consistency of the stabilization voltage and minimization of the heat input into the cryostat. Precisely these criteria are better met in the above-mentioned embodiments of the inventive flux pump than in conventional flux pumps.

One advantageous embodiment of the inventive arrangement comprises a superconducting magnet coil system having one or more coils wound with high-temperature superconductors. The potentially higher drift during use of high-temperature superconductors can be compensated for with the inventive flux pump thereby maintaining the field stability of the superconducting magnet coil system.

The advantages of the inventive arrangement can be fully utilized only through application of suitable methods for operation of the flux pump. A first method is characterized by a particularly simple cycle of charging and discharging of the primary coils and opening and closing of the switches.

In this method for operation of a device with at least one first and one second superconducting secondary coil and a first superconducting switch, the first superconducting switch which bridges the second secondary coil, is periodically opened and closed. When the first switch is closed, the current in a first primary coil which is inductively coupled to the first secondary coil, is brought from an initial value to a final value. When the first switch is opened, the current in this primary coil is again largely reset to the initial value. At the same time, the current in a second primary coil which is coupled to the second secondary coil is brought from an initial value to a final value when the first switch is open, and when the first switch is closed, is largely reset to the initial value.

An improved method using the further second superconducting switch is characterized in that when the first switch is closed, a second superconducting switch which is connected in series with the second secondary coil and is bridged, together therewith, by the first superconducting switch, is opened at least sometimes. This method is advantageous in that the second secondary coil is not charged in an uncontrolled manner when the current in the second primary coil is reset. In a particularly advantageous manner, the current in the second primary coil is reset to zero to generate less heat in the supply lines and—in case of a normally conducting second primary coil—in the coil itself.

This method variant may be further improved in that, before the final current of zero ampere is reached in the second primary coil, the current in this coil is set to a value of I*L/K and the second superconducting switch is opened at the latest after this current has been reached, and that during resetting of the current in the second primary coil to the final current of zero amperes and renewed opening of the first superconducting switch, the second superconducting switch remains superconductingly closed, wherein I designates the current in the superconducting magnet coil system, L designates the self inductance of the second secondary coil and K designates the inductive coupling in Henry between the second secondary coil and the second primary coil. This method is described in more detail in the example below. It is particularly advantageous in that no current flows over the first superconducting switch before it is opened. This prevents voltage peaks across the superconducting magnet coil system, which is an important criterion for the use of the inventive flux pump for field stabilization in sensitive applications.

In two further advantageous method variants, the steps of the described methods are cyclically repeated to either charge or discharge the superconducting magnet coil system or to precisely stabilize the current in the magnet coil system to an operational value.

The inventive arrangement also permits use of a method variant which is particularly advantageous in view of reduction of the heat input into the cryostat, wherein the phase of the pump cycle during which no superconducting switch is opened, is longer than the phases with opened, i.e. heated superconducting switches. In contrast thereto, in conventional flux pumps at least one switch must be permanently heated.

Further advantages of the invention can be extracted from the description and the drawing. The features mentioned above and below may be used in accordance with the invention either individually or collectively in arbitrary combination. The embodiments shown and described are not to be understood as exhaustive enumeration but have exemplary character for describing the invention.

The invention is shown in the drawing and is explained in more detail with reference to one embodiment.

DESCRIPTION OF THE PREFERRED EMBODIMENT

Figure 1:
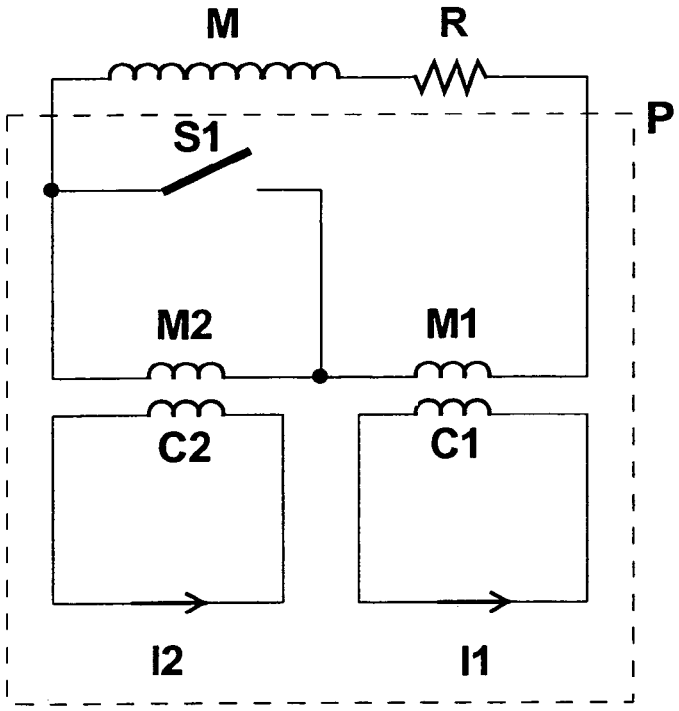
FIG. 1 shows a wiring diagram of an inventive magnet arrangement with a superconducting magnet coil system and a flux pump.

FIG. 1 schematically shows an inventive arrangement which comprises a superconducting magnet coil system M and a flux pump P. The magnet coil system M may have a resistance of magnitude R. Two further superconducting coils M1 and M2 are connected in series with the magnet coil system M, which serve as secondary coils in the flux pump P. A voltage may be induced in these coils through changing the current I1 or I2 in the primary coils C1 or C2 of the flux pump P through inductive coupling. One of the secondary coils, i.e. M2, is bridged with a superconducting switch S1.

Figure 2:
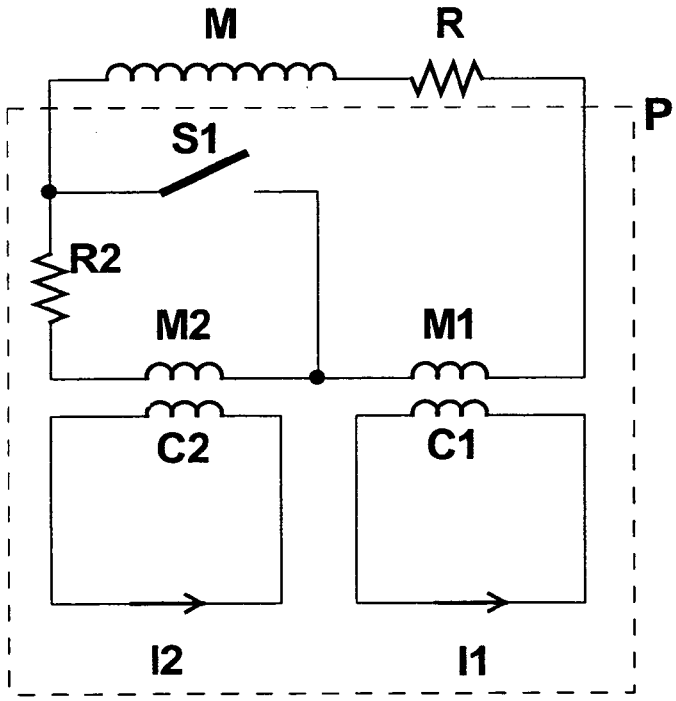
FIG. 2 shows a wiring diagram of an inventive magnet arrangement with a superconducting magnet coil system and a flux pump with an additional resistance in the current path of the flux pump.

FIG. 2 schematically shows an inventive arrangement, wherein the secondary coil M2 which is bridged with the superconducting switch S1 is connected in series with a resistance R2 such that the switch S1 bridges the coil M2 and also the resistance R2.

Figure 3:
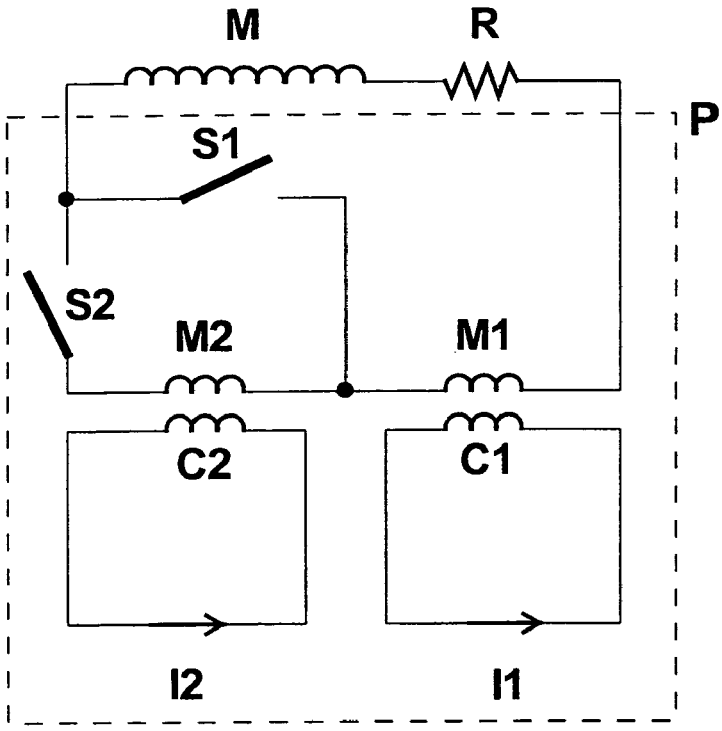
FIG. 3 shows a wiring diagram of an inventive magnet arrangement with a superconducting magnet coil system and a flux pump with an additional superconducting switch in the current path of the flux pump.

FIG. 3 shows an inventive arrangement like FIG. 2 which differs therefrom in that a second superconducting switch S2 is used instead of the resistance R2.

Figure 4:
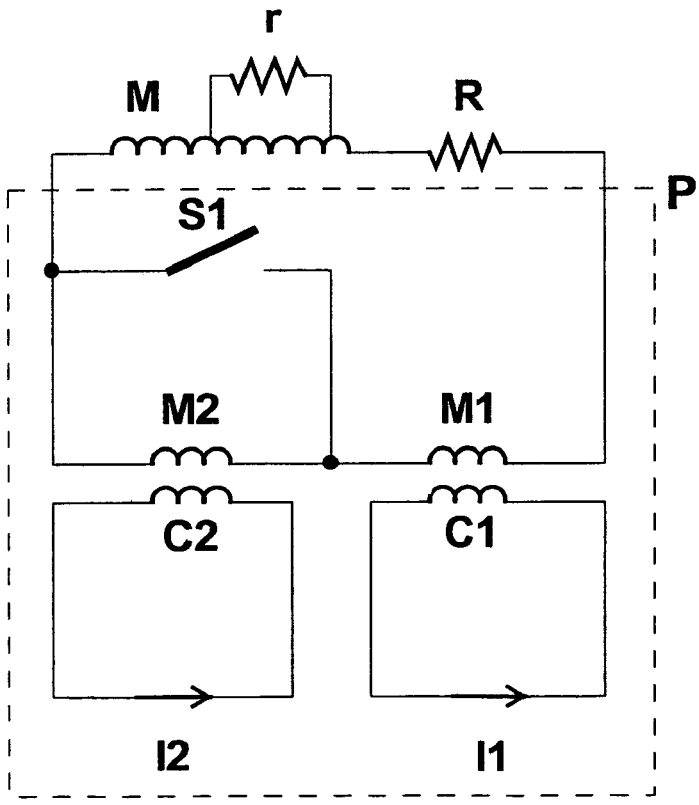
FIG. 4 shows a wiring diagram of an inventive magnet arrangement with a superconducting magnet coil system and a flux pump and an additional resistance which bridges a section of the superconducting magnet coil system.

FIG. 4 shows an inventive arrangement like FIG. 1, wherein one section of the superconducting magnet coil system M is additionally bridged with a resistance r.

Figure 5:
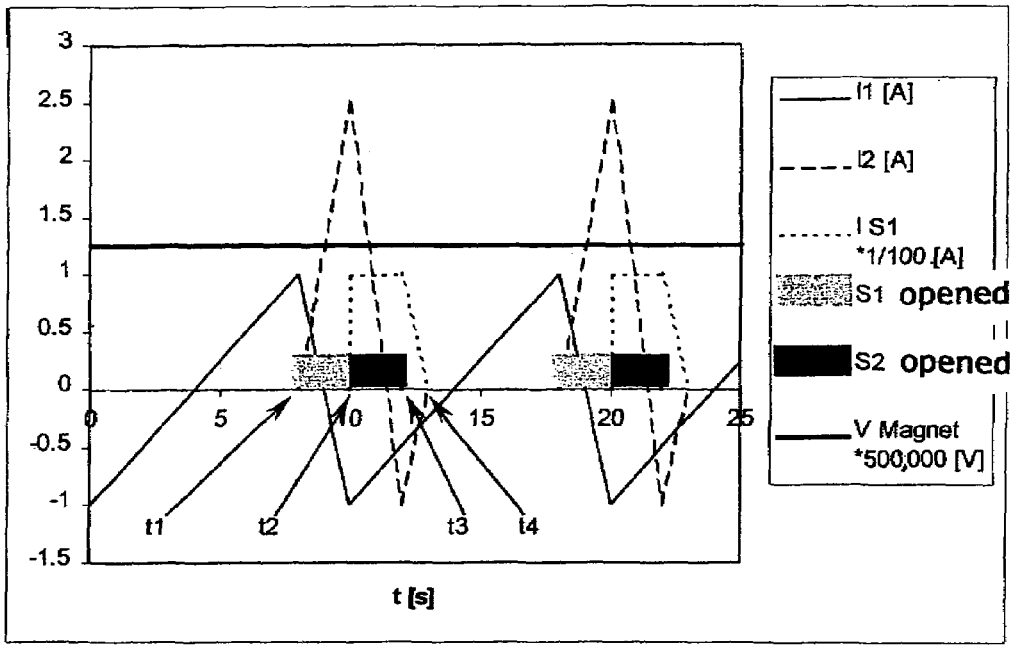
FIG. 5 shows the currents and switching states of the flux pump and the voltage established over the superconducting magnet coil system during several pump cycles for a particularly advantageous method for operating an inventive flux pump.

FIG. 5 shows the currents I1 and I2 in the primary coils C1 and C2 of the flux pump P for an operational method of the inventive flux pump of FIG. 3, and the switching states of the superconducting switches S1 and S2, the current IS1 in the switch S1 and the voltage VMagnet established across the superconducting magnet coil system M via the flux pump P. The time t is plotted towards the right-hand side. The method is optimized to keep the voltage VMagnet constant over any number of pump cycles and prevent voltage peaks. The length of time during which the superconducting switches are opened, is also minimized.

The invention is explained below with reference to one example. The embodiment of FIG. 3 forms the basis of the example of an embodiment of the inventive arrangement. The method applied for operating the flux pump P is that of FIG. 5. It is the aim to maintain a constant voltage VMagnet of 25 $\mu$V over a superconducting magnet coil system M. The components of the flux pump are the following:

LM1=LM2=$10^{-6}$H (inductance of the secondary coils M1 and M2), KMlC1=KM2C2=$10^{-4}$H (inductive coupling between the secondary coil M1 and the primary coil C1 or between M2 and C2), IM=100A (operational current of the superconducting magnet coil system M). All other couplings are zero.

At the beginning and during the first phase of the cycle of the flux pump P between t=0 and t1=8s (FIG. 5), the two switches S1 and S2 are superconductingly closed and the operational current IM of the superconducting magnet coil system M flows through the current path M-M1-M2-S2. The current I2 in the second primary coil C2 is zero and the current I1 in the first primary coil C1 is charged with a continuous ramp of 0.25A/s for 8s from −1A to +1A thereby inducing a voltage of 25 $\mu$V in the secondary coil M1. Since the secondary coil M1 is superconductingly connected to the magnet coil system M, the condition VMagnet=25 $\mu$V is already met in this first phase. At the time t1, the current I1 in the primary coil C1 has reached the maximum value of +1A and shall be discharged again to the initial value of −1A by the time t2=10s. The voltage induced in M1 is −100 $\mu$V in this phase. To keep the voltage VMagnet constant at 25 $\mu$V during this phase, the switch S1 is opened and the current in the second primary coil C2 is increased from zero to 2.5A thereby inducing a voltage of 125 $\mu$V in the second secondary coil M2. Since the switch S1 is opened, the voltages induced in M1 and M2 add in the current path M-M1-M2-S2 to 25 $\mu$V, wherein the condition VMagnet=25 $\mu$V is also met during this phase. At the time t2=10s, the switch S1 is closed again and the charging cycle of the primary coil C1 starts again.

The system has not yet returned to the initial state, since the current I2 in the second primary coil C2 is not zero. When I2 is reset to zero, it must also be ensured that the operational current IM finally flows again through the secondary coil M2 and not via the closed switch S1, i.e. IS1 should be zero. If this condition is not met, an undesired voltage pulse is generated across the superconducting magnet coil system M when the switch S1 is opened again in the next cycle of the flux pump P.

The aim to bring I2 and also IS1 to zero is obtained in that I2 is brought to the value −IM*KM2C2/LM2 between t2 and t3, in the example −1A. The switch S2 is thereby opened, wherein the current in M2 is kept at zero.

The magnet current IM flows through the closed switch S1 between t2 and t3, i.e. IS1=IM=100A. At time t3, the switch S2 is closed again and the current I2 in the second primary coil C2 is subsequently reset to zero at a time t4. This induces a current of an amount of IM in the second secondary coil M2 in the direction of the operational current of the superconducting magnet coil system M such that after t4, the entire operational current IM flows again via the current path M-M1-M2-S2. The second primary coil C2 and the current path M2-S1-S2 are thereby again in the initial state from time t4.

It should be noted that the processes during resetting of the second primary coil C2 and of the current path M2-S1-S2 to the initial state have no influence on the voltage VMagnet which is applied across the superconducting magnet coil system M. The reason therefor is that, during this phase, the switch S1 is always superconducting such that no voltage can be generated over the connecting points of S1 to the current path M-M1-M2-S2. During this phase, the voltage VMagnet over the superconducting magnet coil system M is therefore determined solely through the voltage induced in the secondary coil M1, which is set to the desired value of 25 $\mu$V by the current ramp in the primary coil C1.

The advantages of this arrangement become apparent through the method for operating an inventive flux pump P shown in this example. Firstly, the voltage over the entire cycle of the flux pump P can be kept constant and no voltage peaks occur during opening of the superconducting switches. Secondly, the switches are opened only for a fraction of the operational cycle of the flux pump P, which minimizes the heat input into the cryostat through the switches.

In comparison with a conventional flux pump comprising only one primary coil, in an inventive arrangement, at least two primary coils C1 and C2 must be supplied with current. This increases the heat input into the cryostat through the current feed lines of the primary coils. This disadvantage of the example shown has, however, only little effect, since the second primary coil C2 carries current only for a fraction of the operational cycle of the flux pump P, thereby keeping the heat development in the feed lines small.

If a superconducting magnet coil system is to be used for nuclear magnetic resonance, the requirements for the temporal stability of the magnetic field are particularly high. The overall resistivity of the magnet coil system must typically not exceed a magnitude of $0.1*10^{-9}$ ohms such that the field drift is acceptable. The field can be stabilized with an inventive flux pump of the above-mentioned type even when the resistivity of the superconducting magnet coil system is in the order of magnitude of VMagnet/IM=25 $\mu$V/100A=$250*10^{-9}$ ohms. The resistivity of the magnet coil system may be more than a thousand times higher than in an arrangement without the inventive flux pump.

An inventive magnet arrangement comprises a superconducting magnet coil system M and at least two superconducting secondary coils M1, M2 which are connected in series with the magnet coil system, and a first superconducting switch S1 which can bridge the second of the secondary coils M2 in a superconducting manner. In a particularly advantageous manner, the magnet arrangement has a second superconducting switch S2 which is connected in series with the second secondary coil M2, wherein the first superconducting switch S1 can bridge both the second secondary coil M2 and second superconducting switch S2. It is possible to produce a predeterminable voltage in each of the secondary coils M1, M2 through inductive coupling using at least two independent primary coils C1, C2. The system of secondary coils, primary coils and superconducting switches forms a flux pump P for the magnet coil system. This flux pump is suitable for long-term stabilization of the magnetic field of the magnet coil system during operation, i.e. for drift compensation in the magnet coil system.

We claim:

1. A magnet system comprising:

a superconducting main magnet coil, said main magnet coil having an ohmic resistance of zero or more during operation thereof;

a first superconducting secondary coil connected in series with said main magnet coil;

a second superconducting secondary coil connected in series with said first secondary coil and said main magnet coil;

a first superconducting switch circuited to bridge at least said second secondary coil;

a first primary coil inductively coupled to said first secondary coil;

means for supplying said first primary coil with a first current;

a second primary coil inductively coupled to said second secondary coil; and means for supplying said second primary coil with a second current, independent of said first current, wherein said first secondary coil, said second secondary coil, said first superconducting switch, said first primary coil, said first current means, said second primary coil and said second current means cooperate to form a flux pump for said main magnet coil.

2. The magnet system of claim 1, comprising n≧2 secondary coils connected in series with said main magnet coil or parts thereof, wherein at least one, but not more than n−1 secondary coil(s) are superconductingly bridged through closing of one or more superconducting switches.

3. The magnet system of claim 1, wherein said first superconducting switch bridges said second secondary coil together with a resistance which is connected in series with said second secondary coil, wherein said resistance has a value, measured in ohms, of between 0 and a value of the inductance of said second secondary coil, measured in Henrys.

4. The magnet system of claim 1, wherein said first superconducting switch bridges said second secondary coil together with a second superconducting switch which is connected in series with said second secondary coil.

5. The magnet system of claim 1, wherein said first secondary coil is substantially inductively decoupled from said second primary coil and said second secondary coil is substantially inductively decoupled from said first primary coil.

6. The magnet system of claim 1, wherein said first secondary coil is substantially inductively decoupled from said second secondary coil.

7. The magnet system of claim 1, wherein at least one of said first and said second primary coils is largely inductively decoupled from said main magnet coil.

8. The magnet system of claim 1, wherein at least one of said first and said second secondary coils is largely inductively decoupled from said main magnet coil.

9. The magnet system of claim 1, wherein said main magnet coil has a working volume and at least one of said first and said second primary coils generates substantially no field in said working volume.

10. The magnet system of claim 1, wherein said main magnet coil has a working volume and at least one of said first and said second secondary coils generates substantially no field in said working volume.

11. The magnet system of claim 1, wherein at least one of said first and said second primary coils is superconducting.

12. The magnet system of claim 11, wherein at least one of said first and said second primary coils is fed via feed lines which are at least partially superconducting.

13. The magnet system of claim 1, wherein said first superconducting switch can be actuated by a heater whose feed lines are at least partially superconducting.

14. The magnet system of claim 1, wherein at least a section of said main magnet coil is bridged by a resistance, wherein this resistance has a value, measured in ohms, of between 0 and a value of the inductance of said bridged magnet section, measured in Henrys.

15. The magnet system of claim 1, wherein said main magnet coil is structured and dimensioned for nuclear magnetic resonance measurements.

16. The magnet system of claim 1, wherein said main magnet coil comprises coils of high-temperature superconducting material.

17. A method for operating a magnet system the magnet system having a superconducting main magnet coil, the main magnet coil having an ohmic resistance of zero or more during operation of said main magnet coil, and with a first superconducting secondary coil connected in series with the main magnet coil as well as a second superconducting secondary coil connected in series with the first secondary coil and the main magnet coil, a first superconducting switch circuited to bridge at least the second secondary coil, and a first primary coil inductively coupled to the first secondary coil, means for supplying the first primary coil with a first current, a second primary coil inductively coupled to the second secondary coil, and means for supplying said second primary coil with a second current, independent of said first current, wherein said first secondary coil, said second secondary coil, said first superconducting switch, said first primary coil, said first current means, said second primary coil and said second current means cooperate to form a flux pump for the main magnet coil, the method comprising the steps of:

a) bringing said first current through said first primary coil from a first current initial value to a first current final value with the first switch closed;

b) resetting said first current to the first current initial value with the first switch opened;

c) bringing the second current in the second primary coil from a second current initial value to a second current final value with the first switch opened; and d) resetting the second current to the second current initial value with the first switch closed.

18. The method of claim 17, wherein the magnet system further comprises a second superconducting switch connected in series with the second secondary coil and bridged, together with the second secondary coil, by the first superconducting switch, wherein the second superconducting switch is opened, at least at times, when the first switch is closed.

19. The method of claim 18, wherein the second current final value in the second primary coil is substantially 0 amperes.

20. The method of claim 19, wherein, before the second current final value of 0 ampere has been reached in the second primary coil, the second current is set to a value of I*L/K and, at the latest when this current has been reached, the second superconducting switch is opened, and during resetting of the second current in the second primary coil to the second current final value of 0 amperes, and up to renewed opening of the first superconducting switch, the second superconducting switch remains superconductingly closed, wherein I designates a current in the main magnet coil, L a self inductance of the second secondary coil, and K a mutual inductance in Henrys between the second secondary coil and the second primary coil.

21. The method of claim 17, wherein a current in at least part of the main magnet coil is changed through cyclic repetition of at least part of method steps a) through d).

22. The method of claim 17, wherein a current in at least part of the main magnet coil is kept constant at a value of more than zero through cyclic repetition of at least part of method steps a) to d).

23. The method of claim 22, wherein an ohmic resistance of the main magnet coil is different from zero.

24. The method of claim 17, wherein, during a method cycle, a time during which the first superconducting switch is opened, is shorter than a time during which the first switch is closed.

25. The method of claim 18, wherein, during a method cycle, a time during which the second superconducting switch is opened is shorter than a time during which the second switch is closed.

* * * * *